US007075494B2

(12) United States Patent
Sergey

(10) Patent No.: US 7,075,494 B2
(45) Date of Patent: Jul. 11, 2006

(54) LEAKY-WAVE DUAL POLARIZED SLOT TYPE ANTENNA

(76) Inventor: Bankov Sergey, #301, 243-4 Gui-dong, Gwangiin-gu, Seoul (KR)

( * ) Notice: Subject to any disclaimer, the term of this patent is extended or adjusted under 35 U.S.C. 154(b) by 13 days.

(21) Appl. No.: 10/511,873

(22) PCT Filed: Apr. 16, 2003

(86) PCT No.: PCT/KR03/00768

§ 371 (c)(1),
(2), (4) Date: Oct. 18, 2004

(87) PCT Pub. No.: WO03/090314

PCT Pub. Date: Oct. 30, 2003

(65) Prior Publication Data

US 2005/0219134 A1 Oct. 6, 2005

(30) Foreign Application Priority Data

Apr. 19, 2002 (KR) ..... 10-2002-0021709

(51) Int. Cl.
*H01Q 13/00* (2006.01)

(52) U.S. Cl. ..... 343/770; 343/700 MS

(58) Field of Classification Search ..... 343/770, 343/700 MS, 768, 767, 850, 853
See application file for complete search history.

(56) References Cited

U.S. PATENT DOCUMENTS 3,044,066 A 7/1962 Butler
4,833,482 A 5/1989 Trinh et al.

(Continued)

FOREIGN PATENT DOCUMENTS

EP 0 798 807 A2 10/1997

(Continued)

OTHER PUBLICATIONS

PCT International Search Report (as published), International Application No. PCT/KR03/00768, Date of Completion of Search—Jul. 14, 2003.

(Continued)

*Primary Examiner*—Hoanganh Le
(74) *Attorney, Agent, or Firm*—Park Law Firm; John K. Park

(57) ABSTRACT

Disclosed is a leaky-wave dual polarized slot type antenna, including: a first shielding layer lying in an XY plane; a first dielectric layer on top of the first shielding layer; a first feeding circuit section formed on the top of the first dielectric layer, including a plurality of first strip lines formed of first loops with a first designated shape from one side of the dielectric layer in the direction of the X-axis at a predetermined first period, in order to feed electromagnetic waves; a second feeding circuit section formed on the top of the first dielectric layer, including a plurality of second strip lines formed of second loops with a second designated shape from the other side of the dielectric layer in the direction of the X-axis at the predetermined first period, in order to feed the electromagnetic waves; a second dielectric layer formed on the top part of the first and second feeding circuit sections; and a second shielding layer with a first slot section and a second slot section, formed on the top of the second dielectric layer, transmitting the electromagnetic waves fed to the first and second feeding circuit sections as vertical polarization and horizontal polarization.

6 Claims, 9 Drawing Sheets

U.S. PATENT DOCUMENTS

| | | | | | |
|---|---|---|---|---|---|
| 5,189,433 | A | * | 2/1993 | Stern et al. | 343/770 |
| 5,467,100 | A | | 11/1995 | Chen | |
| 5,579,019 | A | | 11/1996 | Uematsu et al. | |
| 5,977,924 | A | * | 11/1999 | Takei et al. | 343/770 |
| 6,317,094 | B1 | | 11/2001 | Wu et al. | |
| 6,388,621 | B1 | * | 5/2002 | Lynch | 343/700 MS |

FOREIGN PATENT DOCUMENTS

| | | | |
|---|---|---|---|
| JP | 53068960 | * | 6/1978 |
| JP | 54120559 | * | 9/1979 |
| KR | P1998-047739 | | 9/1998 |
| KR | 2002 084 399 | A | 11/2002 |
| KR | 1020020084399 | A | 11/2002 |
| WO | WO 02/089248 | A1 | 11/2002 |

OTHER PUBLICATIONS

Communication from EPO dated Jul. 6, 2005 together with enclosed European Search Report for EP Application No. EP 03 71 7737, Date of Completion of Search: Jun. 29, 2005.

* cited by examiner

LEAKY-WAVE DUAL POLARIZED SLOT TYPE ANTENNA

This application is a 371 of PCT/KR03/00768 filed on Apr. 16, 2003 and claims priority benefits of Republic of Korea Application No. 10-2002-0021709 filed on Apr. 19, 2002.

BACKGROUND OF THE INVENTION

1. Field of the Invention

The present invention relates to a microstrip line feeding slot type planar antenna, more particularly, to a leaky-wave dual polarized slot type antenna, capable of transmitting and receiving orthogonal polarized waves.

2. Description of the Related Art

Radars used in ultra high frequency bands and microwave bands, base station antennas, and antennas for use in satellite communications and satellite broadcasts should have high gains. To have high gains, antennas must have directivity, for example, parabolic antennas.

However, since a parabolic antenna occupies a large surface area for high gain, communication equipment of a base station should be substantially large. Also, the surface of the antenna is usually coated with endocrine disrupter containing materials to prevent rust. As a result, the parabolic antenna causes environment pollution not only when it is used but also when it is disposed.

As an attempt to solve the above problems, radio connection methods for reducing the size and weight of communication equipment of a base station, and development of power controllers and interference controllers, terminals, and network system techniques are making active progress. In particular, a planar antenna such as a microstrip line antenna is small, light and thin, so it is very convenient to use and cheap to manufacture.

The planar antenna, e.g. microstrip line antenna, is utilized for military communications where mobility and maneuverability are required. High communication equipment such as next generation mobile communication system also uses planar antennas for the same reasons.

However, the microstrip line antenna being currently commercialized has drawbacks in that its frequency bandwidth is very narrow and has a low gain. Moreover, it can transmit/receive a single polarized wave only. Thus, to transmit/receive dual polarized waves, a vertically polarized antenna and a horizontally polarized antenna had to be used together at the same time.

SUMMARY OF THE INVENTION

It is, therefore, an object of the present invention to provide a leaky-wave dual polarized slot type antenna with a broad frequency bandwidth.

Another object of the present invention is to provide a leaky-wave dual polarized slot type antenna, capable of increasing gain.

Still another object of the present invention is to provide a leaky-wave dual polarized slot type antenna, capable of transmitting/receiving vertically and horizontally polarized waves simultaneously on a same plane.

To achieve the above object, there is a leaky-wave dual polarized slot type antenna, including: a first shielding layer 11 lying in an XY plane; a first dielectric layer 15 on top of the first shielding layer 11; a first feeding circuit section 17 formed on the top of the first dielectric layer 15, comprising a plurality of first strip lines 19 formed of first loops 19*a* with a first designated shape from one side of the dielectric layer in the direction of the X-axis at a predetermined first period, in order to feed electromagnetic waves; a second feeding circuit section 18 formed on the top of the first dielectric layer 15, comprising a plurality of second strip lines 21 formed of second loops 21*a* with a second designated shape from the other side of the dielectric layer in the direction of the X-axis at the predetermined first period, in order to feed the electromagnetic waves; a second dielectric layer 47 formed on the top part of the first and second feeding circuit sections 17 and 18; and a second shielding layer 33 with a first slot section and a second slot section 35 and 41, formed on the top of the second dielectric layer 47, transmitting the electromagnetic waves fed to the first and second feeding circuit sections 17 and 18 as vertical polarization and horizontal polarization.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE INVENTION

A preferred embodiment of the present invention will now be described with reference to the accompanying drawings.

Figure 1:
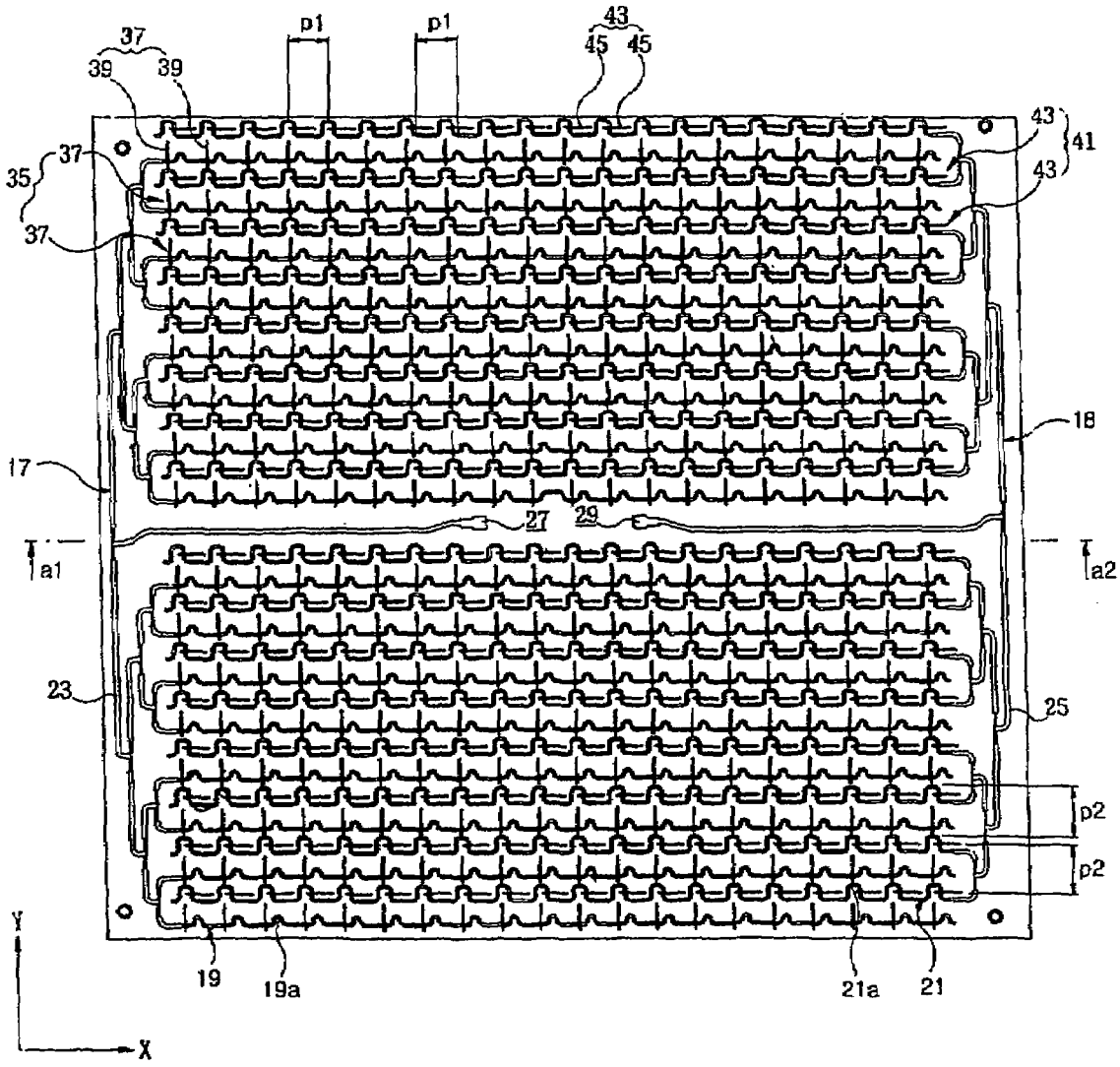
FIG. 1 is a plane view of a leaky-wave dual polarized slot type antenna in accordance with a first preferred embodiment of the present invention.
Figure 2:
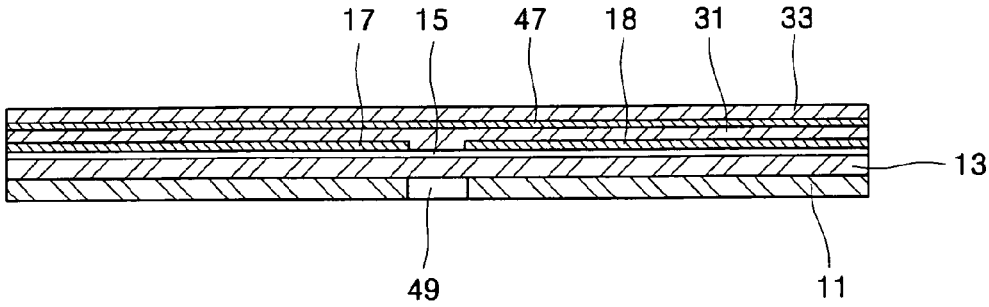
FIG. 2 is a cross-sectional view of the leaky-wave dual polarized slot type antenna, taken along line a1–a2 of FIG. 1.

FIG. 1 is a plane view of a leaky-wave dual polarized slot type antenna in accordance with a first preferred embodiment of the present invention, and FIG. 2 is a cross-sectional view of the leaky-wave dual polarized slot type antenna, taken along line a1–a2 of FIG. 1.

Referring to FIG. 1 and FIG. 2, respectively, the leaky-wave dual polarized slot type antenna according to the first preferred embodiment of the present invention includes a first shielding layer 11, a first spacing section 13 disposed on the first shielding layer 11, a first dielectric layer 15 disposed on the first spacing section 13, first and second feeding circuit sections 17 and 18 disposed on the top (or lower) part of the first dielectric layer 15, a second spacing section 31 disposed on the first and second feeding circuit sections 17 and 18, a second dielectric layer 47 disposed on the second spacing section 31, and a second shielding layer 33 disposed on the lower (or top) part of the second dielectric layer 47. First and second slot sections 35 and 41, which are depicted in FIG. 1, are formed in the second shielding layer 33.

That is, the present embodiment includes a first shielding layer 11, a first spacing section 13 disposed on the first shielding layer 11, a first dielectric layer 15 disposed on the first spacing section 13, first and second feeding circuit sections 17 and 18 disposed on the top part of the first dielectric layer 15, a second spacing section 31 disposed on the first and second feeding circuit section 17 and 18, a second dielectric layer 47 disposed on the second spacing section 31, and a second shielding layer 33 disposed on the top part of the second dielectric layer 47.

Here, the first shielding layer 11 of FIG. 2 is usually made of conductive metals such as copper, aluminum or silver, and has the shape of a plate in the XY plane, preferably being grounded thereto. The first shielding layer 11 not only supports the elements of the antenna mechanically, but also prohibits the propagating waves along the first and second feeding circuit sections 17 and 18 from radiating to the outside in the direction, i.e. −Z-axis. One or two circular or square cavities 49 are formed at the central portion of the first shielding layer 11. The cavity 49 in FIG. 2, a waveguide, is disposed in the opposite direction of a waveguide of an exciter (not shown) installed at the lower portion of the first shielding layer 11.

In like manner, the second shielding layer 33 formed at the lower (or top) portion of the second dielectric layer 47 is a plate with the XY plane on which conductive materials like copper, aluminum or silver is depositioned or adhered. The second shielding layer 33 not only transmits the electromagnetic waves propagated along the first and second feeding circuit sections 17 and 18 as vertically and horizontally polarized waves but also prohibits the waves from radiating to the outside along the direction of +Z-axis. In brief, the first and second shielding layers 11 and 33 prevents the waves propagated via the first and second feeding circuit sections 17 and 18 from radiating along the Z-axis, thereby preventing the waves from radiating to the outside in the vertical direction of the antenna plane.

The first and second slot sections 35 and 41 are formed by patterning the second shielding layer 33 disposed at the lower (or top) portion of the second dielectric layer 47 using a photolithography method. The first slot section 35 has M×N (M, N are natural numbers) of the first slot 39 in a matrix, being perpendicular to the X-axis, and the second slot section 41 also has M×N of the second slot 45 in a matrix, being orthogonal to M×N of the first slot 39 and parallel to the X-axis. That is, the first slot section 35 is an N-row of the first slot array 37 and each row is comprised of M of the first slot 39 being arrayed in the direction of the X-axis, and the second slot section 41 is comprised of N-rows of the second slot array 43 and each row is comprised of M the second slot 45 being arrayed in the direction of the X-axis.

As shown in FIG. 1, the first and second slot sections 35 and 41 have a first period P1 along the X-axis, and a second period P2 along the Y-axis.

More specifically, each of the first and second slot arrays 37 and 43 formed in the direction of the X-axis has the same first period, and each of the first and second slot arrays 37 and 33 formed in the direction of the Y-axis has the same second period.

Each of the first slot 39 and the second slot 45 receives or transmits vertically and horizontally polarized waves, and has the width W and the length L. The width W and the length L should satisfy the condition of W<L. In addition, the width W of each of the first slot 39 and the second slot 45 should be substantially less than the wavelength (λ) of a wave in free space. That is, the condition W<λ should be satisfied.

The first and second feeding circuit sections 17 and 18 feed electromagnetic waves inputted, and are formed by depositioning or adhering conductive metals like copper, silver of aluminum on the top surface of the first dielectric layer 15 and then patterning with the photolithography method. The first feeding circuit section 17 includes N of first strip line 19 being in parallel to the X-axis, a first multi-channel divider 23 and a first central port 27. The second feeding circuit section 18 includes N of second strip line 21 being in parallel to the first strip line 19, a second multi-channel divider 25 and a second central port 29.

These N first and second strip lines 19 and 21 are formed alternately to each other, and connected in parallel to the first and second multi-channel divider 23 and 25 that are formed on one and the other side of the first dielectric layer 15, respectively. The first and second multi-channel dividers 23 and 25 are respectively connected in parallel to the first and second central ports 27 and 29 at the central portion of the antenna. That is, the N first strip lines 19 are connected in parallel to the first multi-channel divider 23 and the N second strip lines 21 are connected in parallel to the second multi-channel divider 25. The first and second multi-channel divider 23 and 25 and the first and second central ports 27 and 29 are formed like a shape of strip line.

In the first strip lines 19, first loops 19*a* are formed at a predetermined period(P1). The length of strip line between two neighboring first slots 39 in the direction of the X-axis of the first strip lines 19 is termed Ls1.

In the second strip lines 21, second loops 21*a* are formed at a predetermined period(p1). The length of strip line between two neighboring second slots 45 in the direction of the X-axis of the second strip lines 21 is termed Ls2.

Each of the second strip line 21 forms a circular second loop 21*a* every first period P1 along the X-axis, crossing the second slot array 43. Thus, the length Ls2 between two neighboring second slots 45 in the direction of the X-axis of the second strip line 21 is greater than the first period P1 because of the loop. Similarly, each of the first strip line 19 forms a semicircular or sine wave-like first loop 19*a* every first period P1 in the direction of the X-axis, crossing the first slot array 37. Moreover, the length Ls1 between two neighboring first slots 39 in the direction of the X-axis of the first strip line 19 is greater than the first period P1.

Here, the distance between any two arbitrary neighboring first loops 19*a* formed in the direction of the X-axis is constant, and in like manner, the distance between any two arbitrary neighboring second loops 21*a* formed in the direction of the X-axis is constant, as seen in FIG. 1. Also, the formation period of the first loops 19*a* on each of the first strip line 19 along the X-axis is same as the formation period of the second loop on each of the second strip line 21 along the X-axis.

The first and second strip lines 19 and 21 have a second period P2, respectively, in the direction of the Y-axis. As one can conclude from FIG. 1, the distance between any two neighboring first strip lines formed along the Y-axis is also equal to the distance between any two neighboring second strip lines formed along the Y-axis.

The first and second central ports 27 and 29 in FIG. 1 are disposed inside the cavity 49 of the first shielding layer 11, to be in opposite direction of the waveguide of the exciter. Therefore, when transmitting a signal, the electromagnetic wave is guided through the waveguide, and input to the first and second central ports 27 and 29.

Preferably, the first and second dielectric layers 15 and 47 shown in FIG. 2 are made of materials with dielectric constant is 2–3, such as, polyethylene, compressed polystyrene, polypropylene or Teflon in a film.

The first and second spacing sections 13 and 31 shown in FIG. 2, respectively, separate the first shielding layer 11 from the first dielectric layer 15, and the second dielectric layer 47 from the first and second feeding circuit sections 17 and 18, respectively. Here, the first and second spacing sections 13 and 31 are formed of materials with dielectric constant of approximately 1, e.g. foam polystyrene, thereby creating an environment similar to free space. In this manner, no dielectric loss caused by the first and second spacing sections 13 and 31 is generated.

The operation principles of the leaky-wave dual polarized slot type antenna according to the first preferred embodiment of the present invention are now explained.

When the exciter generates an electromagnetic wave, the wave is guided to the first and second central ports 27 and 29 through the waveguide, and distributed to the first and second multi-channel dividers 23 and 25, respectively, and finally propagates to the N first and second strip lines 19 and 21, respectively. The wave propagates to these N first strip lines 19 and N second strip lines 21 in opposite directions from each other.

The M×N first and second slots 39 and 45 composing the first and second slot sections 35 and 41 polarize and radiate the wave propagated to the N first strip lines 19 and N second strip lines 21 with the vertical and horizontal polarization of each. In other words, when the electromagnetic wave propagates the N first strip lines 19 and N second strip lines 21, an electromagnetic coupling is induced between the M×N first slots 39 and the M×N second slots 45, and the M×N first and second slots 39 and 45 excited by this electromagnetic coupling polarize and radiate the wave in the vertical and horizontal polarization.

The vertically and horizontally polarized waves are radiated from the first and second slot sections 35 and 41, and in order to make the radiation pattern thereof have one single main beam, the periods P1 and P2 should be designated, satisfying the following equations.

$$P1<\lambda/(1+\sin\theta) \quad \text{[Equation 1]}$$

$$P2<\lambda \quad \text{[Equation 2]}$$

The angle (θ) in Equation 1 is the angle between the main beam of the radiating wave and the Z-axis. That is, the vertically and horizontally polarized waves from the first and second slot sections 35 and 41 radiate not perpendicularly to XY-plane but at an off-perpendicular angle, i.e., at the angle (θ) from the Z-axis. Since the wave propagates from the first and second strip lines 19 and 21 in the direction of the X-axis, the angle (θ) is also the angle between the X-axis and the Z-axis. Hence, the main beam of the horizontally and vertically polarized waves by the first and second slot sections 35 and 41 is located at the XZ plane.

The waves propagates on the first and second strip lines 19 and 21 in opposite directions from each other. The radiating angle (θ) of the main beam is positive (+) when the angle is in approximately the opposite direction to the propagating direction of the wave at an arbitrary strip line, and negative (−) when the angle is in approximately the same direction as the propagating direction of the wave at an arbitrary strip line. Thus, the horizontally and vertically polarized waves of the first and second slot sections 35 and 41 radiate in the same direction and form one main beam.

Figure 3A:
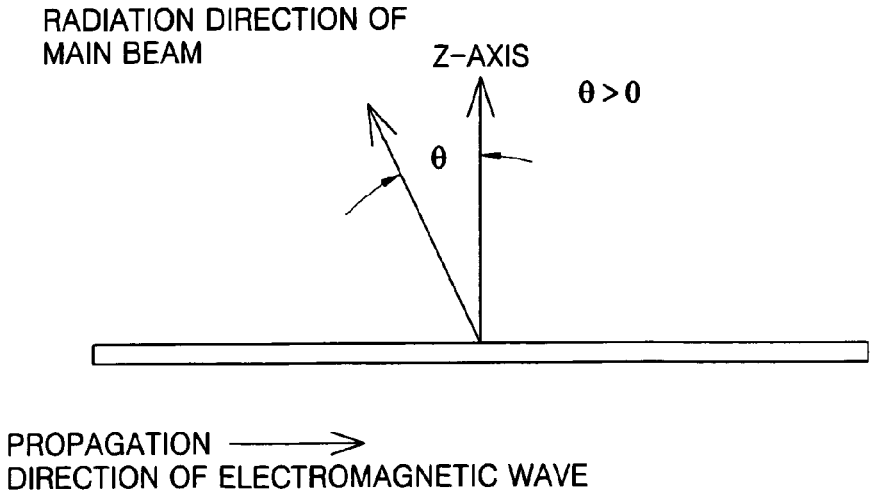
FIG. 3*a* and FIG. 3*b* are schematic diagrams illustrating opposite radiation directions of main beam according to waves that propagate on a first and second strip line in FIG. 1.
Figure 3B:
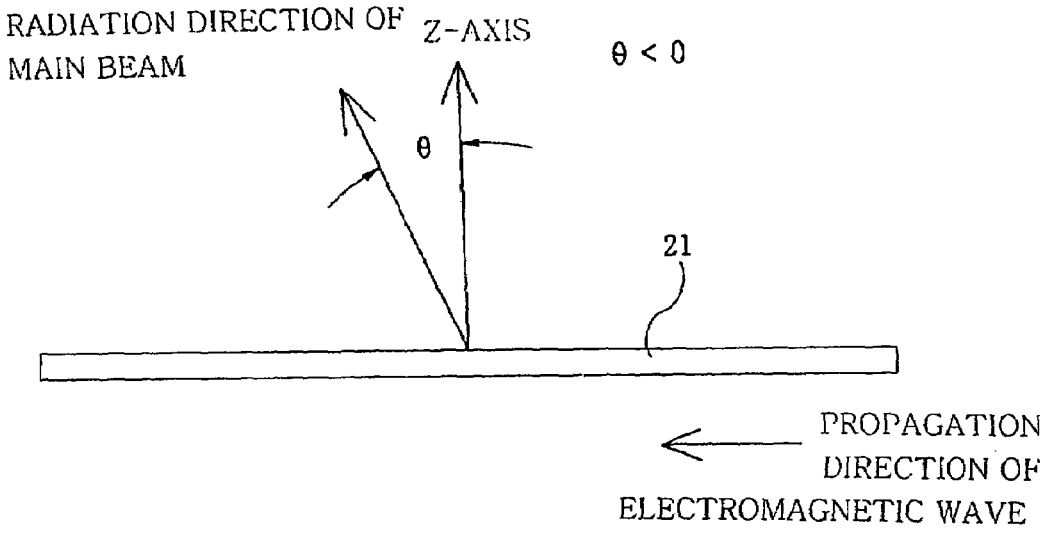

FIG. 3*a* and FIG. 3*b* are schematic diagrams illustrating radiating directions of main beam according to waves that propagate to opposite directions on a first and second strip line in FIG. 1. More particularly, FIG. 3*a* illustrates a case when the radiation angle (θ) of the main beam of the vertically polarized wave is positive (+), i.e. θ>0, as the electromagnetic wave propagates from the left side to the right side at the first strip line 19, and when the main beam of the vertically polarized wave is inclined to the left direction, that is, in approximately the opposite direction to the propagating direction of the wave. Also, FIG. 3*b* illustrates a case when the radiation angle (θ) of the main beam of the horizontally polarized wave is negative (−) i.e. θ<0, as the electromagnetic wave propagates from the right side to the left side of the second strip line 21, and in the main beam of the horizontally polarized wave is inclined to the left direction, that is, to the propagating direction of the wave. The angle (θ) can be expressed as in Equation 3.

$$\sin\theta = \frac{2\Pi}{kP1} - \sqrt{\varepsilon}\frac{Ls}{P1} \quad \text{[Equation 3]}$$

wherein, k is the free space wave number(k=2π/λ), and ϵ is the dielectric constant of the first and second spacing sections 13 and 31. Also, Ls is the length of a strip line between two neighboring slots, and can be substituted by Ls 1 and Ls2. Here, the main beam is not perpendicular to the first and second slot sections 35 and 41, and the radiation angle (θ) depends on frequency.

Provided that the radiation angle between the main beam of the horizontally polarized wave and Z-axis is positive (+), the length Ls1 between two neighboring first slots 39, and the length Ls2 between two neighboring second slots 41 can be expressed by Equation 4 and Equation 5, respectively.

$$Ls1 = \frac{P1}{\sqrt{\varepsilon}}\left(\frac{2\Pi}{kP1} - \sin\theta\right) \quad \text{[Equation 4]}$$

$$Ls2 = \frac{P1}{\sqrt{\varepsilon}}\left(\frac{2\Pi}{kP1} + \sin\theta\right) \quad \text{[Equation 5]}$$

Angle θ in equations (4) and (5) should be taken as positive in both cases.

Because the main beam of the vertically and horizontally polarized waves are oriented in the same direction, the radiation angle (θ) is same, except that it is distinguished by (+) angles and (−) angles. Based on the lengths Ls1 and Ls2 and the radiation angle expressed in Equations 4 and 5, Equation 6 which connects lengths Ls1 and Ls2 can be derived as follows.

$$\frac{2c}{fo} = \sqrt{\varepsilon}\,(Ls1 + Ls2) \qquad \text{[Equation 6]}$$

Here, c is the velocity of the wave in free space, and fo is a central frequency in the operational frequency range of the antenna. The lengths Ls1 and Ls2 should be carefully selected to orient the main beam of the vertically and horizontally polarized waves in the same direction.

Also, the vertically and horizontally polarized waves radiated from the first and second slot sections 35 and 41 have a phase shift (ϕ) between two neighboring first slots 39 and between two neighboring second slots 45, respectively. The phase shift (ϕ) can be expressed as Equation 7.

$$\varnothing = k\sqrt{\varepsilon}Ls \qquad \text{[Equation 7]}$$

It is important that the vertically polarized waves radiated from each of the first slots 39 of the first slot section 35 have the same phase and thus, the same signal characteristic. In like manner, it is important that the horizontal waves radiated from each of the second slots 45 of the second slot section 41 of the second slot section 45 have the same phase and thus, the same signal characteristic. Therefore, it is preferable that the phase shift (ϕ) for vertically and horizontally polarized waves be identical.

So far, the leaky-wave dual polarized slot type antenna transmits orthogonally polarized waves. But the reception of waves takes place in opposite direction to the direction in which waves are transmitted. Plane waves in free space plane are horizontally and vertically polarized by the M×N first and second slots 39 and 45 of the first and second slot sections 35 and 41, and propagated to the N first and second strip lines 19 and 21 of the first and second feeding circuit sections 17 and 18. The N first and second strip lines 19 and 21 which alternate with the first and second slot arrays 37 and 43 function as a serial summator of the propagating waves of vertical and horizontal polarization. On the other hand, the first and second multi-channel divider 23 and 25 function as a parallel summator of the vertical and horizontal waves propagated to the N first and second strip lines 19 and 21. Since the first and second multi-channel dividers 23 and 25 function as the parallel summator, each has a wide operational frequency range.

Waves summated by the first and second multi-channel dividers 23 and 25 are distributed to the exciter through the first and second central ports 27 and 29.

In general, antenna gain is determined by antenna square and phase-amplitude distribution in the antenna aperture. The phase-amplitude distribution of the antenna in the case of transmitting waves is uniform along the Y-axis by multi-channel dividers. Meanwhile, the phase-amplitude distribution along the X-axis is determined by coupling of the first and second slots 39 and 45 and the first and second strip lines 19 and 21. If the coupling level is constant along the first and second strip lines 19 and 21, the amplitude is determined by X as exponential function. The optimal coupling makes possible the leaky-wave antenna with constant coupling have a maximum gain. The gain loss for optimizing the leaky-wave antenna is about 1 dB.

Figure 4:
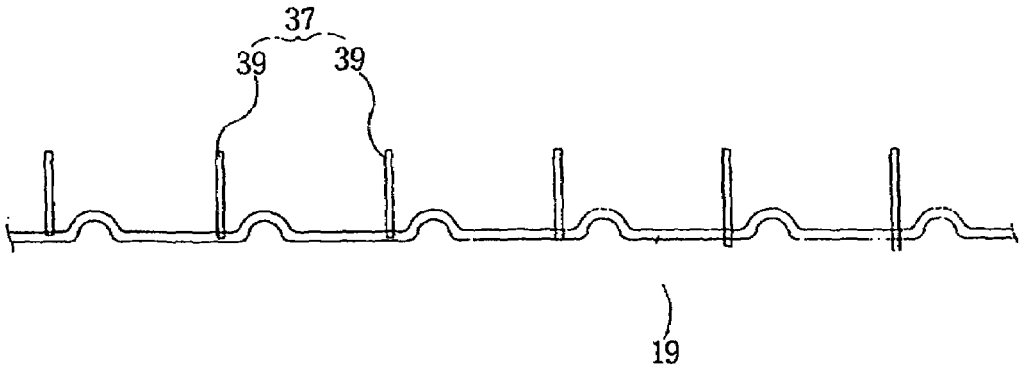
FIG. 4 is a schematic diagram showing non-uniform coupling between a first slot array and a first strip line of FIG. 1.

FIG. 4 is a schematic diagram showing non-uniform coupling between the first a slot array 37 and the first a strip line 19 of FIG. 1.

The coupling level between the first slot array 37 and the first strip line 19 is increased to the propagating direction of the wave on the strip line. At this time, the amplitude along the first strip line 19 is almost uniformly distributed, and thus, the gain loss is reduced. The coupling level between the first slot 39 and the first strip line 19 is dependent on the position of an intersection point. As the intersection point gets closer to the center of the first and second slots 39 and 45, the coupling level is increased. Therefore, when the wave propagates from the left side to the right side in FIG. 4, variable coupling is obtained when each of the first slots 39 of the first slot array 37 has a different intersection point for the first strip line 19.

Overall, the antenna gain can be expressed as Equation 8.

$$G = 10\log\left(\frac{4\pi}{\lambda^2}S\cos(\theta)\right) - \delta, \qquad \text{[Equation 8]}$$

Here, S denotes an antenna's aperture square, and δ denotes gain loss caused by the non-uniform amplitude distribution in the direction of the X-axis. In Equation 8, dissipative loss was ignored. The antenna of constant coupling between the slots and the strip lines has approximately 1 dB of loss (δ), while the optimized antenna of a variable coupling has about 0.5–0.3 dB of loss (δ).

Particularly, the resonance properties of the first and second slots 39 and 45 are used for increasing the operational frequency range for satellite TV system. The operational frequency range of the antenna is generally limited primarily because the radiation angle is dependent on the frequency. However, this does not apply to a resonance slot.

When the lengths of the first and second slots 39 and 45 are close to λ/2 (where λ is a free space wavelength) or slightly less than the half wavelength, resonance is generated. The first and second slots 39 and 45 violently disturb wave in the first and second strip lines 19 and 21 at frequencies close to resonance frequency of the first and second slots 39 and 45. Hence, the propagation constant of this wave is extraordinarily dependent on a frequency within the resonance frequency range. This dependence helps one to compensate conventional dependence of angle of radiation on frequency. The radiation angle within a certain range around resonance frequency of the first and second slots 39 and 45 may be stabilized.

Figure 5:
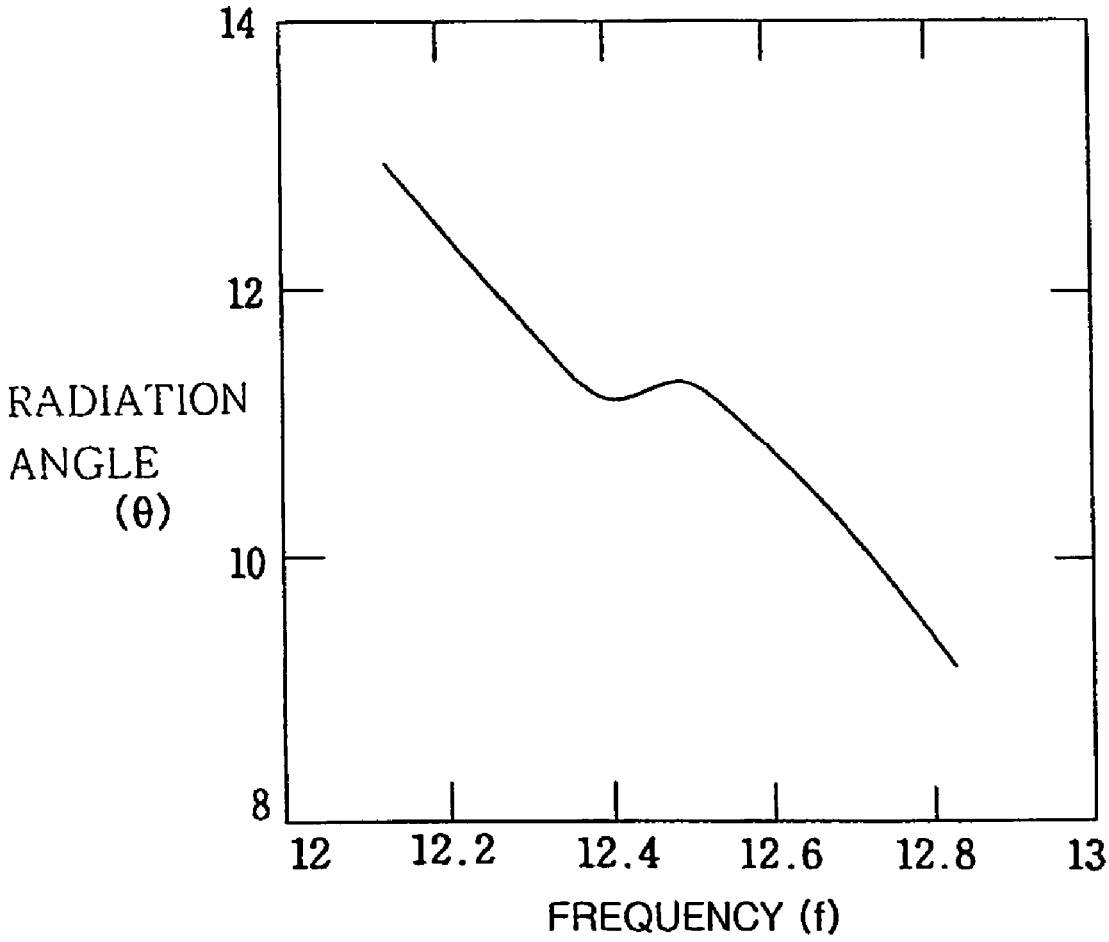
FIG. 5 graphically depicts a relation between radiation angles (θ) and frequencies (f) in accordance with the first preferred embodiment of the present invention.
Figure 6:
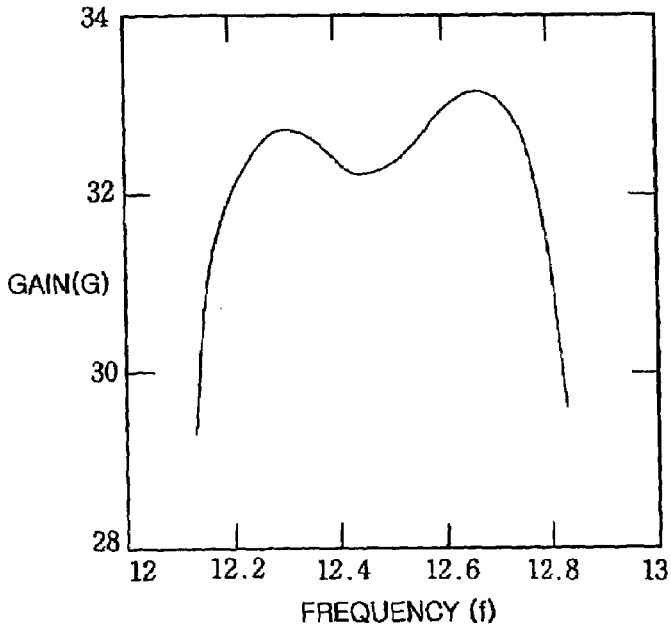
FIG. 6 graphically depicts a relation between gains (G) and frequencies (f) in accordance with the first preferred embodiment of the present invention.

FIG. 5 illustrates the relation between radiation angles (θ) and frequencies (f). As shown in FIG. 5, the radiation angle (θ) changes less than ±1° within the frequency range of 12.2 GHz to 12.75 GHz. Because the change of the radiation angle (θ) is very small, a stable gain can be obtained within the same frequency range. FIG. 6 graphically depicts a relation between gains (G) and frequencies (f). Here, the relative bandwidth is about 5%, and which is more than twice of case of conventional array.

Figure 7:
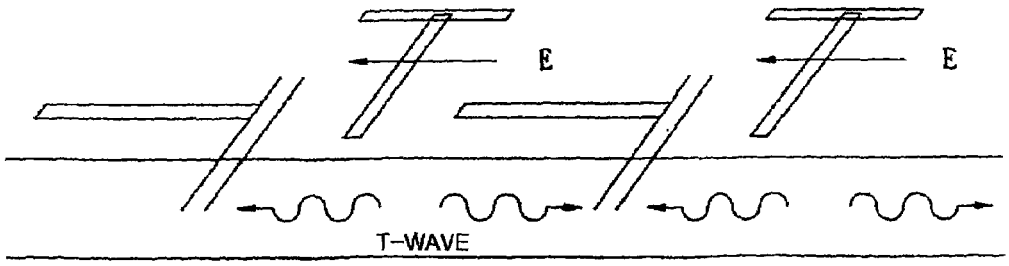
FIG. 7 is a diagram showing a state in which a first slot and a second slot are in cross-polarization to each other in accordance with the first preferred embodiment of the present invention.

FIG. 7 is a diagram showing a state in which a first slot and a second slot are in cross-polarization with respect to each other.

Different patterns of waves propagates in the first and second feeding sections 17 and 18, such as, effective waves (also called strip line waves), which propagate while being connected to the first and second strip lines 19 and 21, and parasitic waves (also called T-waves), which propagate alone without being connected to the first and second strip lines 19 and 21. Here, the T-wave is excited by the first and second slots 39 and 45, and generated between the first and second feeding sections 17 and 18 and the second shielding layer 33, propagating in the horizontal direction. The T-wave is able to carry electromagnetic energy through neighboring slots, without being connected by the first and second strip lines 19 and 21. As a result, the T-wave produce coupling of orthogonal slots of the first and second slots 39 and 45, and increases cross-polarization.

In other words, as shown in FIG. 7, when an electric field of the wave propagating in the first strip line 19 is generated, only the first slot 39 that is perpendicular to the electric field of the wave gets excited. However, the first slots 39 excites not only the effective wave in the first strip line 19 but also the T-wave between the first and second feeding sections 17 and 18 and the second shielding layer 33 which in turn excites the orthogonal second slot arrays 43. Thus, the T-wave increases cross-polarization by exciting the second orthogonal slot that has the same amplitude.

To prevent cross-polarization, the second slots 45 are disposed symmetrically between two neighboring first slots 39. At this point, the T-wave from the left side and the T-wave from the right side have the same amplitude and have a phase difference of 180°, do not excite the second slot 45.

Figure 8:
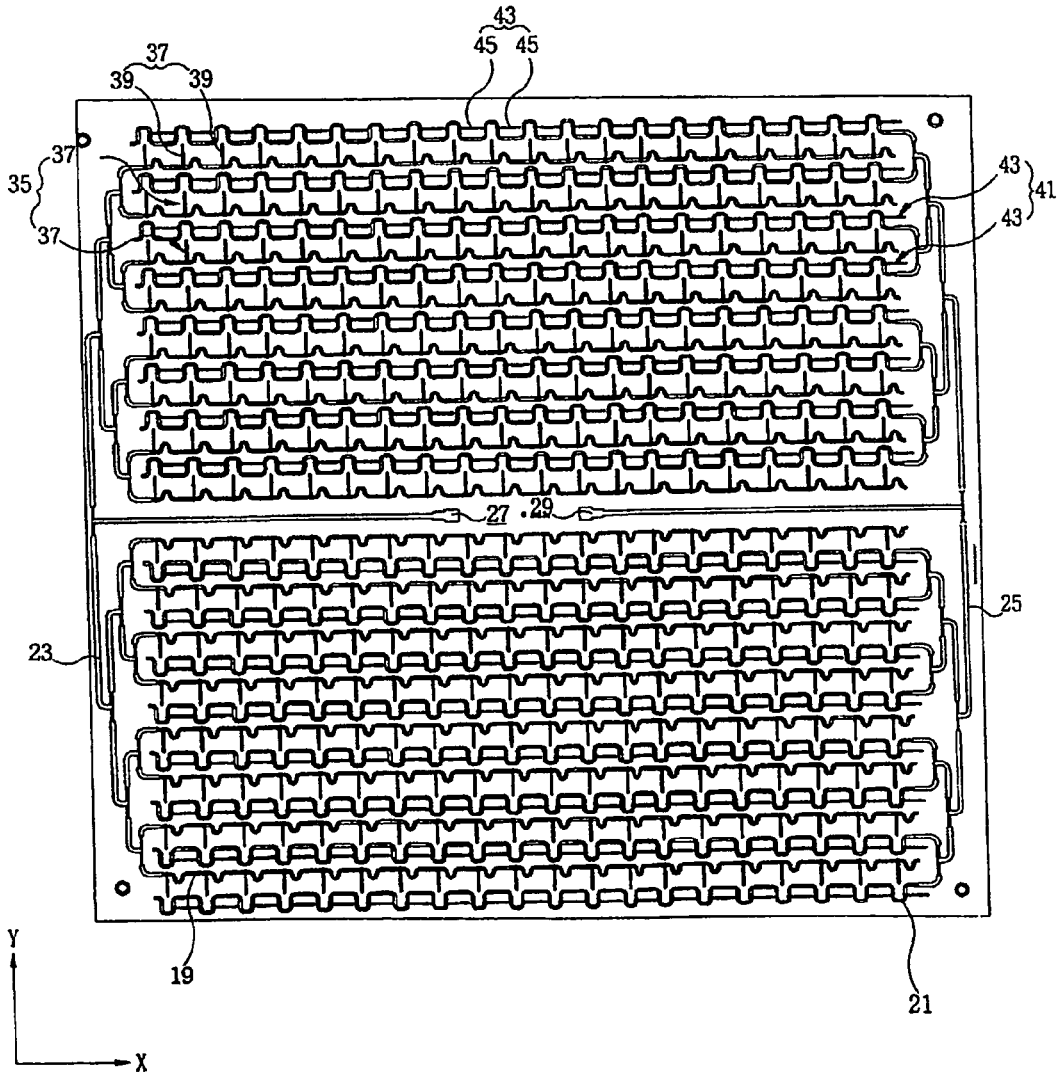
FIG. 8 is a plane view of a leaky-wave dual polarized slot type antenna in accordance with a second preferred embodiment of the present invention.

FIG. 8 is a plane view of a leaky-wave dual polarized slot type antenna in accordance with a second preferred embodiment of the present invention.

Referring to FIG. 8, the leaky-wave dual polarized slot type antenna according to the second embodiment is different from that of the first embodiment in that the N-first and second strip lines 19 and 21 and the first and second slot sections 35 and 41 have different shapes. That is, N-first strip lines 19 and N-second strip lines 21 of the leaky-wave dual polarized slot type antenna according to the first embodiment of the present invention are asymmetrically formed around the first and second central ports 27 and 29. However, the first and second strip lines 19 and 21, and the first and second slot sections 35 and 41 of the leaky-wave dual polarized slot type antenna according to the second embodiment of the present invention are divided into halves (N/2) around the first and second central ports 27 and 29, the first and second loops 19 *a* and 21 *a* of each being symmetrical to each other. In addition upper part (or down part) of the second multi channel divider 25 contains a strip line loop that produces 180 deg. phase shift.

In the leaky-wave dual polarized slot type antenna according to the second embodiment of the present invention, the first and second slots 39 and 45 are excited by their crossing slots, namely the second and first slots 45 and 39. However, since the N-first and second strip lines 19 and 21 are divided into halves, i.e. N/2, around the first and second central ports 27 and 19, they have symmetric structures to each other, and the waves of these two symmetric first and second strip lines 19 and 21 are phase-shifted by 180°. These 180° phase-shifted waves compensate each other, and do not propagate to the first and second central ports 27 and 29, consequently reducing a cross-polarization level.

Except for the above properties, no further details on the operational properties of the leaky-wave dual polarized slot type antenna according to the second embodiment of the present invention will be provided here because they are basically identical with the leaky-wave dual polarized slot type antenna according to the first embodiment of the present invention.

Figure 9:
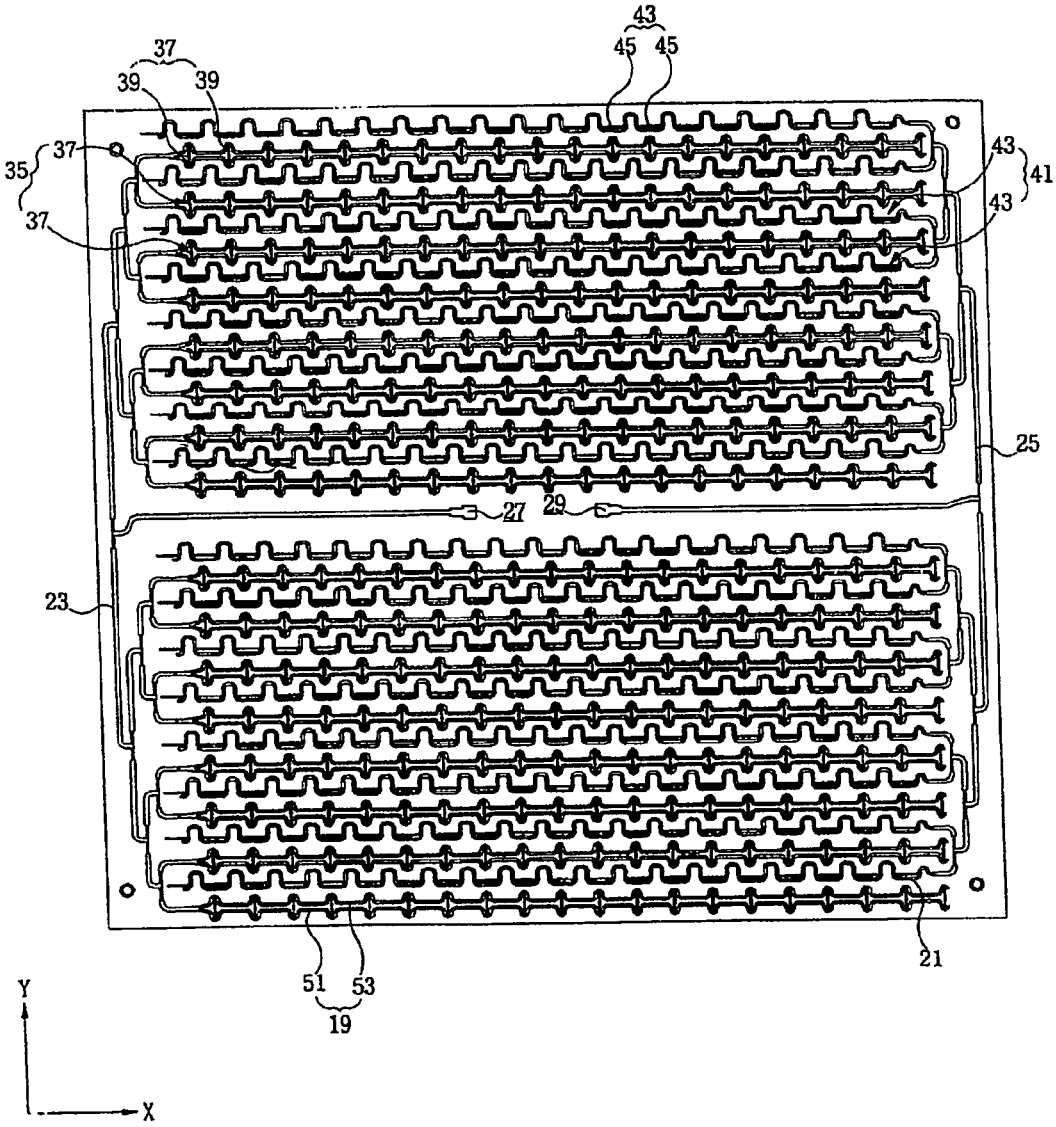
FIG. 9 is a plane view of a leaky-wave dual polarized slot type antenna in accordance with a third preferred embodiment of the present invention.

FIG. 9 is a plane view of a leaky-wave dual polarized slot type antenna in accordance with a third preferred embodiment of the present invention.

Referring to FIG. 9, in the leaky-wave dual polarized slot type antenna in accordance with the third preferred embodiment of the present invention, the first and second slot sections 35 and 41 have different constructions, compared to the first embodiment of the present invention illustrated in FIG. 1. That is, the first strip line 19 includes a first sub-line 51 and a second sub-line 53. The first and second sub-lines 51 and 53 have symmetrical structures with respect to each other, and are formed to cross to both ends of the first slot 39. The second strip lines 21 are oriented in one direction.

In the leaky-wave dual polarized slot type antenna in accordance with the third preferred embodiment of the present invention, the first slots 39 are connected to the first sub-line 51 and the second sub-line 53, so the first slots 39 are symmetrically excited by sub-lines 51 and 53, so the electric field distribution thereof is always symmetrical. As such, even though the second slot 45 might be comparatively symmetrical to the first slot 39, the first slot 39 is not excited by the second slot 45. Hence, the reduction of cross-polarization level is realized more substantially at wide angles of directions.

No further details on the operational properties, except for the above properties, of the leaky-wave dual polarized slot type antenna according to the third embodiment of the present invention will be provided here because they are basically identical with the leaky-wave dual polarized slot type antenna according to the first embodiment of the present invention.

Actually, the leaky-wave dual polarized slot type antenna according to the third embodiment, in which the first strip lines 19 are composed of the first and second sub-lines 51 and 53, and the N-second strip lines 21 are symmetrically divided into N/2 strip lines around the first and second central ports 27 and 29, as shown in FIG. 8, can be easily derived from the leaky-wave dual polarized slot type antenna according to the first embodiment.

Figure 10:
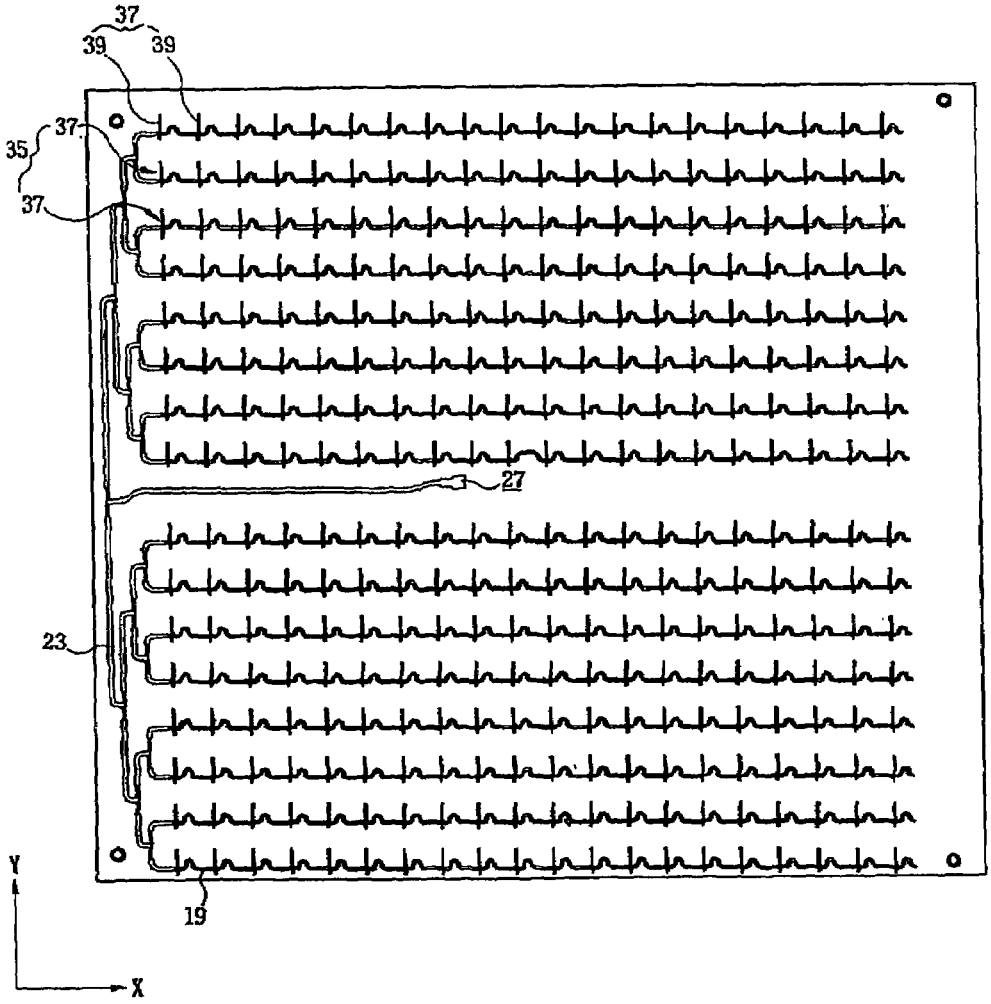
FIGS. 10 and 11 are plane views illustrating a leaky-wave single/dual polarized slot type antenna, respectively, in accordance with a fourth preferred embodiment of the present invention.
Figure 11:
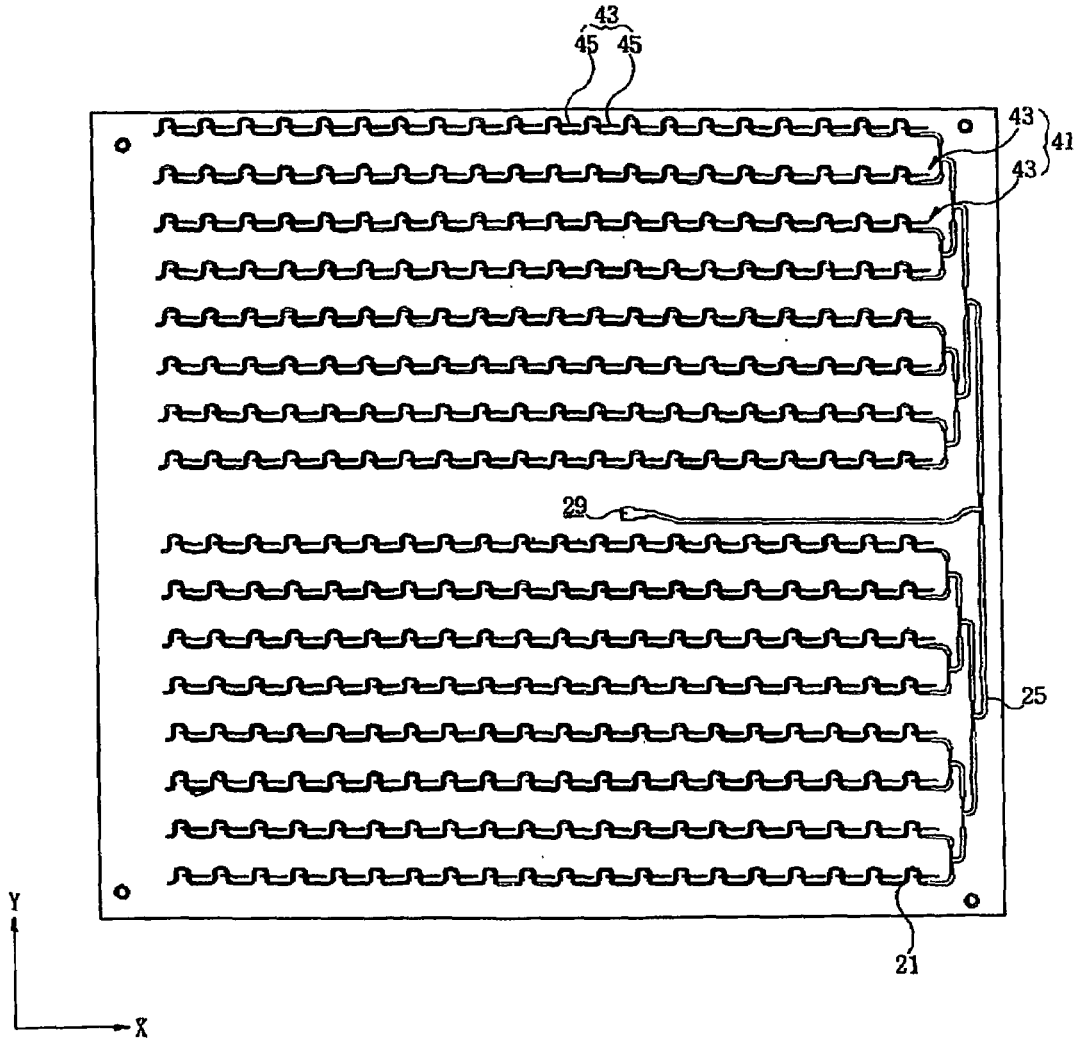

FIGS. 10 and 11 are plane views illustrating a leaky-wave single/dual polarized slot type antenna, respectively, in accordance with a fourth preferred embodiment of the present invention.

Referring to FIGS. 10 and 11, the leaky-wave single and dual polarized slot type antenna, respectively, in accordance with the fourth preferred embodiment of the present invention are distinguished from the leaky-wave dual polarized slot type antenna according to the first embodiment in that there exists separately each of the first and second feeding circuit sections 17 and 18 of FIG. 1 exist separately as depicted in FIGS. 10 and 11. Therefore, in order to propagate electromagnetic waves, each of the feeding circuit section in FIG. 10 and FIG. 11 has either each corresponding the first strip line 19 or the second strip line 21, the first strip fine 19 having the first loop 19*a* from one side of the first dielectric layer 15 of FIG. 1 to the direction of the X-axis, and the second strip line 21 having the second loop 21*a* from the side of the first dielectric layer 15 to the direction of the X-axis.

As such, the second shielding layer 33 of FIG. 1, as illustrated in FIG. 10 and FIG. 11 respectively, is formed at the lower (or top) portion of the second dielectric layer 47 of FIG. 1, in a manner that it induces an electromagnetic coupling with the strip lines formed on either the first slot section 35 or the second slot section 41, thereby horizontally or vertically polarizing electromagnetic waves propagated along the feeding circuit section of FIG. 10 or FIG. 11 and then transmitting the waves.

In short, if the feeding circuit section of FIG. 10 or FIG. 11 is replaced with the first and second feeding circuit sections 17 and 18 of FIG. 1, it can transmit/receive only vertically polarized waves or horizontally polarized waves.

However, the construction described in FIG. 1, in which the first and second feeding circuit sections 17 and 18 are separately disposed on the two dielectric layers for transmitting/receiving horizontally and vertically polarized waves, respectively, can be also easily derived.

For example, suppose that the feeding circuit section equipped with the first strip line, and its corresponding shielding layer equipped with the first slot array for receiving and transmitting the vertically polarized waves are used instead of the first and second feeding circuit sections 17 and 18 of FIG. 1. Then a third dielectric layer should be separately formed on the top of the second shielding layer 33 formed at the lower (or top) part of the second dielectric layer 47, and in order to propagated electromagnetic waves on the top or lower portion of the third dielectric layer, a feeding circuit section including the second strip line, having the second loop from the other side of the third dielectric layer to the X-axis, should be formed in the symmetrical direction of the first strip line of FIG. 1. Also, a fourth dielectric layer should be separately formed on the top of the second feeding circuit section 2, and a third shielding layer including the second slot array for horizontally polarizing and transmitting the electromagnetic waves propagating on the second feeding circuit section should be formed on the lower (or top) portion of the fourth dielectric layer. Here, the positions of the first feeding circuit section and the second feeding circuit section can be switched, and thus the shielding layers thereof should be preferably switched also.

The leaky-wave dual polarized slot type antenna of the present invention can be advantageously used since it has a broader frequency bandwidth than the related art, and can increase gain. As a result, the transmission/receiving characteristics of the leaky-wave dual polarized slot type antenna are substantially improved.

Also, the leaky-wave dual polarized slot type antenna can improve basic properties of antennas in that it can simultaneously transmit and receive horizontally and vertically polarized waves being transmitted/received through multi channels on the same plane of an antenna.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A leaky-wave dual polarized slot type antenna, comprising:

a first shielding layer lying in an XY plane;

a first dielectric layer on top of the first shielding layer;

a first feeding circuit section formed on the top of the first dielectric layer, comprising a plurality of first strip lines formed of first loops with a first designated shape from one side of the dielectric layer in the direction of the X-axis at a predetermined first period, in order to feed electromagnetic waves;

a second feeding circuit section formed on the top of the first dielectric layer, comprising a plurality of second strip lines formed of second loops with a second designated shape from the other side of the dielectric layer in the direction of the X-axis at the predetermined first period, in order to feed the electromagnetic waves;

a second dielectric layer formed on the top part of the first and second feeding circuit sections; and a second shielding layer with a first slot section and a second slot section, formed on the top of the second dielectric layer, transmitting the electromagnetic waves fed to the first and second feeding circuit sections as vertical polarization and horizontal polarization.

2. The antenna according to claim 1, wherein the first strip lines and the second strip lines are formed alternately.

3. The antenna according to claim 1, wherein the first strip lines are comprised of a pair of first and second symmetrical sub-lines.

4. The antenna according to claim 1, wherein the first strip lines are connected in parallel to a first multi-channel divider and the second strip lines are connected in parallel to a second multi-channel divider.

5. The antenna according to claim 1, wherein the first and second feeding circuit sections are divided by at least one central port of the Y-axis, the ports having designated shapes and lengths, and the first strip lines and the second strip lines are symmetrical around the ports.

6. The antenna according to claim 1, wherein the first and second feeding circuit sections are divided by at least one central port of the Y-axis, the ports having designated shapes and lengths, and the first strip lines and the second strip lines are asymmetrical around the ports.

* * * * *

UNITED STATES PATENT AND TRADEMARK OFFICE

CERTIFICATE OF CORRECTION

PATENT NO. : 7,075,494 B2
APPLICATION NO. : 10/511873
DATED : July 11, 2006
INVENTOR(S) : Bankov Sergey It is certified that error appears in the above-identified patent and that said Letters Patent is hereby corrected as shown below:

It is respectfully requested that the assignee information be posted on the patent certificate as follows for the purpose of preserving the assignee's rights related with the patent in accordance with 37 CFR § 1.323. Please reissue a corrected certificate for the above-identified U.S. patent. Please be informed that the assignment was filed and recorded prior to paying the issue fee.

Please insert:

Name of Assignee: Ji Ho Ahn

Residence: 105-601 Samhwan Apt. 897-2, Shingil-dong, Youngdeungpo-ku, Seoul
Republic of Korea Signed and Sealed this Sixth Day of March, 2007

JON W. DUDAS
*Director of the United States Patent and Trademark Office*